US009977395B2

(12) United States Patent
Shibuya

(10) Patent No.: US 9,977,395 B2
(45) Date of Patent: May 22, 2018

(54) IMAGE FORMING APPARATUS FOR IMAGE FORMATION THROUGH TRANSFER OF TONER IMAGES TO TRANSFER TARGET IN SUPERIMPOSED MANNER

(71) Applicant: KYOCERA Document Solutions Inc., Osaka (JP)

(72) Inventor: Teppei Shibuya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/503,902

(22) PCT Filed: Oct. 5, 2015

(86) PCT No.: PCT/JP2015/078231
§ 371 (c)(1),
(2) Date: Feb. 14, 2017

(87) PCT Pub. No.: WO2016/067841
PCT Pub. Date: May 6, 2016

(65) Prior Publication Data

US 2017/0277110 A1 Sep. 28, 2017

(30) Foreign Application Priority Data

Oct. 31, 2014 (JP) ..... 2014-222829

(51) Int. Cl.
*G03G 15/00* (2006.01)
*G03G 21/00* (2006.01)
(Continued)

(52) U.S. Cl.
CPC ..... *G03G 15/80* (2013.01); *G03G 15/5004* (2013.01); *G03G 15/751* (2013.01);
(Continued)

(58) Field of Classification Search
CPC .. G03G 15/80; G03G 15/5004; G03G 15/751; G03G 15/757; G03G 15/657; G03G 21/0017; G03G 21/06; G03G 21/08
See application file for complete search history.

(56) References Cited

U.S. PATENT DOCUMENTS 6,421,521 B2 7/2002 Tanaka
7,769,328 B2 8/2010 Murayama et al.
(Continued)

FOREIGN PATENT DOCUMENTS

JP 2001-255761 A 9/2001
JP 2002-318494 A 10/2002
(Continued)

*Primary Examiner* — Joseph S Wong
(74) *Attorney, Agent, or Firm* — Studebaker & Brackett PC

(57) ABSTRACT

An image forming apparatus (1) includes photosensitive drums (41*y*, 41*c*, 41*m*, and 41*k*), static eliminators (45*y*, 45*c*, 45*m*, and 45*k*), transfer rollers (54*y*, 54*c*, 54*m*, and 54*k*), a power source (55*a*) for transfer, and load resistors (47*y*, 47*c*, 47*m*, and 47*k*). The static eliminators (45*y*, 45*c*, and 45*m*) perform static elimination on adjacently upstream or downstream photosensitive drums (41*y*, 41*c*, 41*m*, and 41*k*) in a movement direction of a transfer target. The transfer rollers (54*y*, 54*c*, 54*m*, and 54*k*) are disposed opposite to the respective photosensitive drums (41*y*, 41*c*, 41*m*, and 41*k*). The power source (55*a*) for transfer applies potential to the transfer rollers (54*y*, 54*c*, 54*m*, and 54*k*). The load resistors (57*y*, 57*c*, 57*m*, and 57*k*) are respectively connected in parallel to one another and in series between the power source (55*a*) for transfer and the respective transfer rollers (54*y*, 54*c*, 54*m*, and 54*k*).

10 Claims, 6 Drawing Sheets

(51) Int. Cl.
*G03G 21/06* (2006.01)
*G03G 21/08* (2006.01)

(52) U.S. Cl.
CPC ..... *G03G 15/757* (2013.01); *G03G 15/657* (2013.01); *G03G 21/0017* (2013.01); *G03G 21/06* (2013.01); *G03G 21/08* (2013.01)

(56) References Cited

U.S. PATENT DOCUMENTS

| | | | | |
|---|---|---|---|---|
| 7,890,034 | B2 | 2/2011 | Murayama et al. | |
| 8,660,464 | B2 | 2/2014 | Ishino et al. | |
| 2001/0031160 | A1 | 10/2001 | Tanaka | |
| 2005/0095437 | A1* | 5/2005 | Furuya ..... | G03G 15/1685 428/423.1 |
| 2006/0251450 | A1 | 11/2006 | Murayama et al. | |
| 2008/0159783 | A1* | 7/2008 | Jung ..... | G03G 15/169 399/128 |
| 2010/0260521 | A1 | 10/2010 | Murayama et al. | |
| 2011/0249987 | A1 | 10/2011 | Ishino et al. | |
| 2013/0136499 | A1* | 5/2013 | Kamiyama ..... | G03G 21/08 399/128 |
| 2013/0195488 | A1* | 8/2013 | Hatano ..... | G03G 15/0189 399/66 |
| 2013/0195507 | A1* | 8/2013 | Morishita ..... | G03G 15/169 399/128 |

FOREIGN PATENT DOCUMENTS

| | | | |
|---|---|---|---|
| JP | 2004-258432 | A | 9/2004 |
| JP | 2007-041086 | A | 2/2007 |
| JP | 2011-221405 | A | 11/2011 |
| JP | 2012-023491 | A | 2/2012 |

* cited by examiner

IMAGE FORMING APPARATUS FOR IMAGE FORMATION THROUGH TRANSFER OF TONER IMAGES TO TRANSFER TARGET IN SUPERIMPOSED MANNER

TECHNICAL FIELD

The present invention relates to image forming apparatuses.

BACKGROUND ART

In order to improve office environments and the like, many electrographic image forming apparatuses employ charging methods for charging a photosensitive drum (photosensitive member) through which ozone is generated a little in recent years. A charging method using a DC charging roller has been known as one of the charging methods in which ozone is generated a little. However, an image forming apparatus employing the charging method using the DC charging roller can charge the photosensitive drum less than an image forming apparatus employing a typical charging method (scorotron method). For this reason, electric charge charged to the surface of the photosensitive drum by a transfer electric filed may not be canceled through charging in subsequent processing in the image forming apparatus employing the charging method using the DC charging roller. As a result, the surface potential of the photosensitive drum may be non-uniform so that an electrostatic latent image subjected to transfer in the previous processing may remain on the surface of the photosensitive drum. In a situation as above, generally-called transfer memory, which is a phenomenon in which image density differs in a halftone image or the like, may be likely to occur. An invention that solves the above problem is disclosed in Patent Literature 1.

Patent Literature 1 discloses a tandem image forming apparatus that removes charge from a positively chargeable photosensitive drum before transfer. Specifically, the image forming apparatus disclosed in Patent Literature 1 includes a plurality of image forming units for respective colors disposed along a circulation direction (movement direction) of an intermediate transfer belt. The image forming units each include a static eliminator that irradiates with light a photosensitive drum located adjacently upstream in the circulation direction of the intermediate transfer belt. Further, a static eliminator among the static eliminators included in the respective image forming units that is located between adjacent photosensitive drums irradiates with light also a photosensitive drum adjacently downstream in the circulation direction of the intermediate transfer belt. In the above configuration, the surfaces of the respective photosensitive drums that each carry a toner image (the surfaces of the photosensitive drums before toner images are transferred) are subjected to static elimination, thereby preventing occurrence of transfer memory.

CITATION LIST

Patent Literature

[Patent Literature 1] Japanese Patent Application Laid-Open Publication No. 2012-23491

SUMMARY OF INVENTION

Technical Problem

However, in the image forming apparatus in Patent Literature 1, static elimination is not performed on a photosensitive drum located the most upstream in the circulation direction of the intermediate belt among the photosensitive drums. In the above configuration, surface potential of the most upstream photosensitive drum may be higher than that of the other photosensitive drums in transfer of toner images to the intermediate transfer belt. When a single power source for transfer applies bias voltage to respective primary transfer rollers in a situation as above, a value of an electric current flowing to the most upstream photosensitive drum may be greater than that of electric currents flowing to the other photosensitive drums. As a result, transfer memory may occur.

In order to solve the above problem, there is proposed a scheme in which power sources for transfer are disposed for the respective primary transfer rollers. However, provision of the plural power sources for transfer may prevent reduction in size and cost of the image forming apparatus. For this reason, development of an image forming apparatus is demanded that can prevent occurrence of transfer memory even in a configuration in which a single power source for transfer applies bias voltage to a plurality of primary transfer rollers.

The present invention has been made in view of the foregoing and has an object of providing an image forming apparatus that can achieve reduction in size and cost and that can prevent occurrence of transfer memory.

Solution to Problem

An image forming apparatus according to the present invention is an image forming apparatus that forms an image by transferring toner images to a transfer target in a superimposed manner. The image forming apparatus includes a plurality of photosensitive drums, a plurality of static eliminators, a plurality of transfer rollers, a power source for transfer, and a plurality of load resistors. The plurality of photosensitive drums are disposed in a movement direction of the transfer target. The plurality of static eliminators are disposed downstream of the respective photosensitive drums in the movement direction of the transfer target and perform static elimination on the respective photosensitive drums located upstream in the movement direction of the transfer target. The plurality of transfer rollers are disposed opposite to the respective photosensitive drums. The power source for transfer applies potential to each of at least two transfer rollers including a transfer roller located the most upstream in the movement direction of the transfer target among the plurality of transfer rollers. The plurality of load resistors are connected in parallel to one another and in series between the power source for transfer and the at least two transfer rollers to which the power source for transfer applies potential. A static eliminator among the plurality of static eliminators that is located between adjacent photosensitive drums in the movement direction of the transfer target performs static elimination further on a photosensitive drum that is located downstream thereof in the movement direction of the transfer target among the adjacent photosensitive drums.

Advantageous Effects of Invention

According to the image forming apparatus in the present invention, occurrence of transfer memory can be prevented and reduction in size and cost of the image forming apparatus can be achieved.

DESCRIPTION OF EMBODIMENTS

Figure 1:
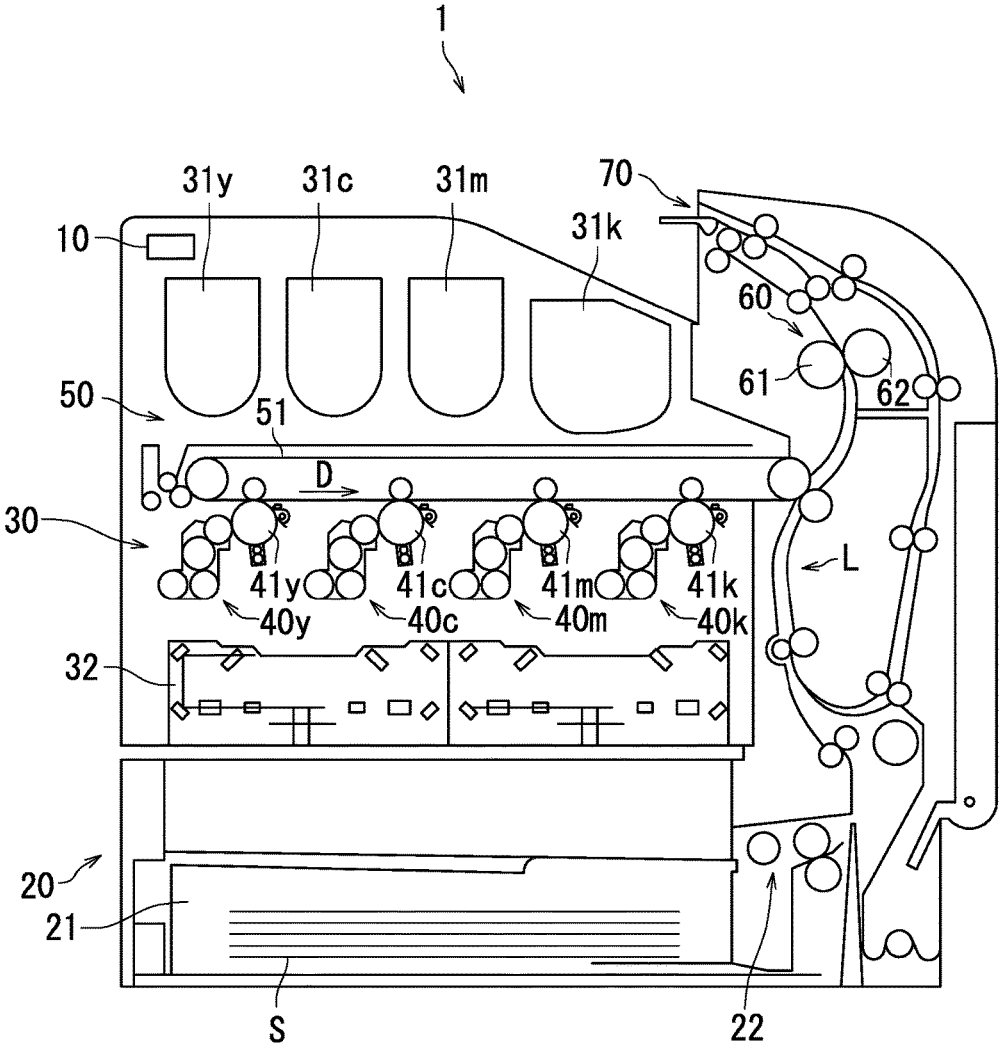
FIG. 1 is a schematic diagram illustrating an image forming apparatus according to an embodiment of the present invention.

Following describes an image forming apparatus according to embodiments of the present invention with reference to the accompanying drawings. Note that like reference signs denote like elements or corresponding elements in the drawings and description thereof is not repeated. The drawings are schematic illustrations that emphasize elements of configuration in order to facilitate understanding thereof. Further, values, material, and the like of each of the elements indicated in the following embodiment are mere examples and not limited specifically, and can be modified in various manners within the scope not substantially departing from advantages of the present invention.

First Embodiment

An image forming apparatus 1 will be described with reference to FIG. 1. FIG. 1 is a schematic diagram illustrating the image forming apparatus 1. The image forming apparatus 1 in the present embodiment is a tandem type multifunction peripheral.

As illustrated in FIG. 1, the image forming apparatus 1 includes a conveyance section L, a controller 10, a sheet feed section 20, an image forming section 30, a fixing section 60, and an ejection section 70.

The conveyance section L conveys a sheet S from the sheet feed section 20 to the ejection section 70 via the fixing section 60.

The controller 10 includes a storage region. The storage region stores therein programs, setting information, etc. The storage region is constituted by a hard disk drive (HDD), a random access memory (RAM), and a read only memory (ROM). The controller 10 controls operation of respective elements of the image forming apparatus 1 through executing control programs pre-stored in the storage region.

The sheet feed section 20 includes a sheet feed cassette 21 and a sheet feed roller group 22. The sheet feed cassette 21 is capable of accommodating a plurality of sheets S. The sheet feed roller group 22 feeds the sheets S accommodated in the sheet feed cassette 21 one at a time to the conveyance section L. Note that the sheets S are an example of recording media.

The image forming section 30 forms images on the sheet S that has been fed. The image forming section 30 includes four toner supplying devices 31*y*, 31*c*, 31*m*, and 31*k*, an exposure device 32, four image forming units 40*y*, 40*c*, 40*m*, and 40*k*, and a transfer section 50.

The toner supplying device 31*y* supplies a yellow toner to the corresponding image forming unit 40*y*. Similarly, the toner supplying devices 31*c*, 31*m*, and 31*k* supply a cyan toner, a magenta toner, and a black toner to the corresponding image forming units 40*c*, 40*m*, and 40*k*, respectively.

The image forming unit 40*y* forms a yellow toner image. Similarly, the image forming units 40*c*, 40*m*, and 40*k* form a cyan toner image, a magenta toner image, and a black toner image, respectively. The image forming units 40*y*, 40*c*, 40*m*, and 40*k* have substantially the same configuration other than the colors of the formed toner images. For the reason as above, the image forming units 40*y*, 40*c*, 40*m*, and 40*k* may be referred to as image forming units 40 in the following description in a situation in which matter common to the respective image forming units 40*y*, 40*c*, 40*m*, and 40*k* is described.

The exposure device 32 exposes photosensitive drums 41 included in the respective image forming units 40 by irradiation with laser light. Through the above, electrostatic latent images are formed on surface of the respective photosensitive drums 41.

The transfer section 50 includes an intermediate transfer belt 51. The transfer section 50 transfers toner images formed by the respective image forming units 40*y*, 40*c*, 40*m*, and 40*k* to the sheet S using the intermediate transfer belt 51 in a superimposed manner. The sheet S to which the toner images have been transferred is conveyed to the fixing section 60.

The fixing section 60 includes a heating member 61 and a pressure member 62. The fixing section 60 fixes the toner images, which has not been fixed yet, to the sheet S by applying heat and pressure to the sheet S using the heating member 61 and the pressure member 62.

The ejection section 70 ejects the sheet S out of an apparatus main body.

Figure 2:
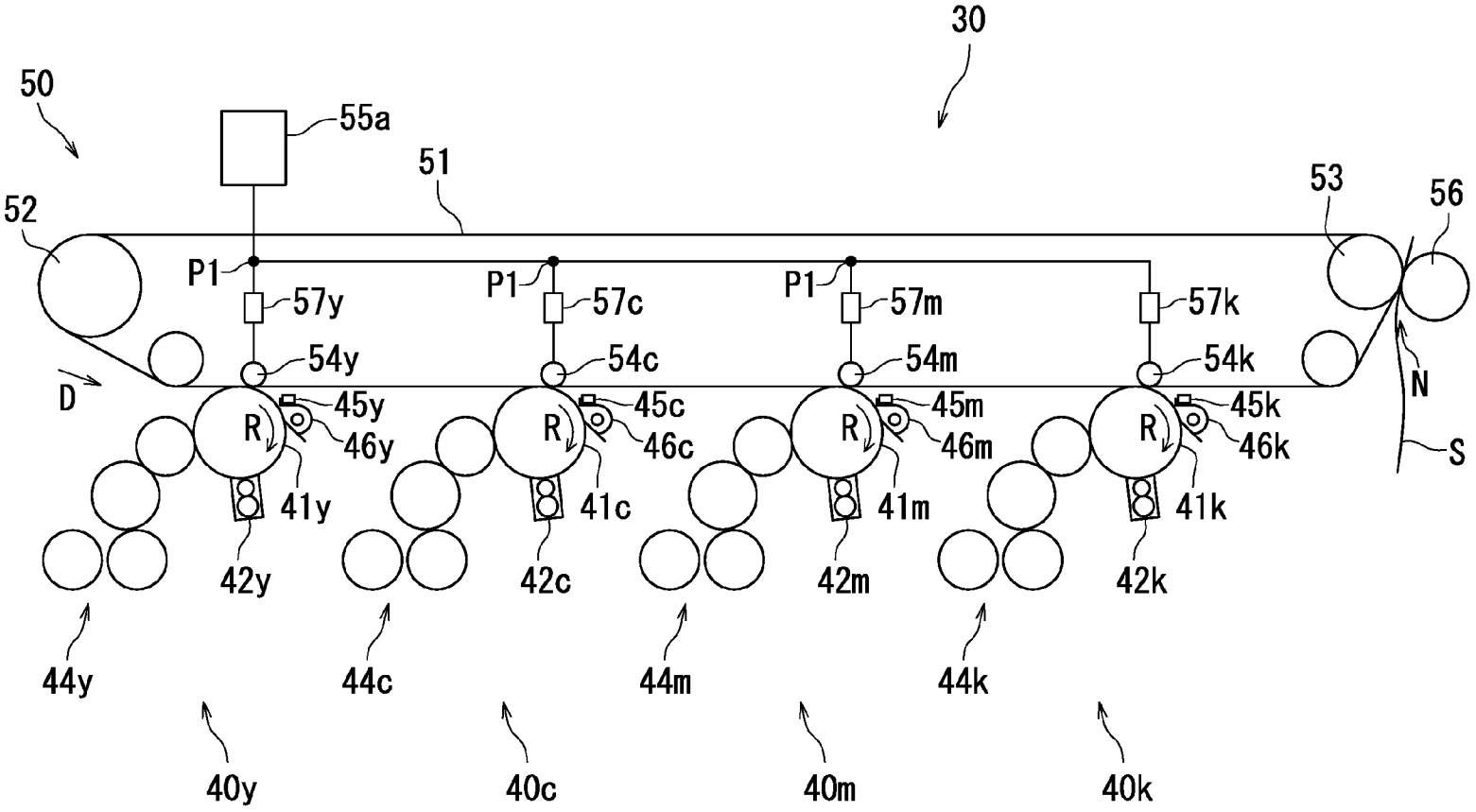
FIG. 2 is a schematic diagram illustrating a part of an image forming section according to a first embodiment of the present invention.

The image forming units 40 and the transfer section 50 will be described next in detail with reference to FIGS. 1 and 2. FIG. 2 is a diagram illustrating a part of the image forming section 30.

As illustrated in FIG. 2, the image forming units 40*y*, 40*c*, 40*m*, and 40*k* are disposed along the intermediate transfer belt 51. Specifically, the image forming units 40*y*, 40*c*, 40*m*, and 40*k* are disposed adjacently to one another in the stated order from upstream to downstream in a circulation direction D (movement direction) of the intermediate transfer belt 51.

The image forming unit 40*y* includes a charger 42*y*, a developing device 44*y*, a static eliminator 45*y*, and a cleaner 46*y* in addition to a photosensitive drum 41*y*. Similarly, the image forming units 40*c*, 40*m*, and 40*k* include respective chargers 42*c*, 42*m*, and 42*k*, respective developing devices 44*c*, 44*m*, and 44*k*, respective static eliminators 45*c*, 45*m*, and 45*k*, and respective cleaners 46*c*, 46*m*, and 46*k* in addition to respective photosensitive drums 41*c*, 41*m*, and 41*k*.

Note that the photosensitive drums 41*y*, 41*c*, 41*m*, and 41*k* have substantially the same configuration. For the reason as above, the photosensitive drums 41*y*, 41*c*, 41*m*, and 41*k* may be referred to as photosensitive drums 41 in the following description in a situation in which matter common to the respective photosensitive drums 41*y*, 41*c*, 41*m*, and 41*k* is described. Also, the chargers 42*y*, 42*c*, 42*m*, and 42*k* have substantially the same configuration. For the reason as above, the chargers 42*y*, 42*c*, 42*m*, and 42*k* may be referred to as chargers 42 in the following description in a situation in which matter common to the respective chargers 42*y*, 42*c*, 42*m*, and 42*k* is described. In addition, the developing devices 44*y*, 44*c*, 44*m*, and 44*k* have substantially the same configuration. For the reason as above, the developing devices 44*y*, 44*c*, 44*m*, and 44*k* may be referred to as developing devices 44 in the following description in a situation in which matter common to the respective developing devices 44*y*, 44*c*, 44*m*, and 44*k* is described. Moreover, the static eliminators 45*y*, 45*c*, 45*m*, and 45*k* have substantially the same configuration. For the reason as above, the static eliminators 45*y*, 45*c*, 45*m*, and 45*k* may be referred to as static eliminators 45 in the following description in a situation in which matter common to the respective static eliminators 45*y*, 45*c*, 45*m*, and 45*k* is described. Yet, the cleaner 46*y*, 46*c*, 46*m*, and 46*k* have substantially the same configuration. For the reason as above, the cleaners 46*y*, 46*c*, 46*m*, and 46*k* may be referred to as cleaners 46 in the following description in a situation in which matter common to the cleaners 46*y*, 46*c*, 46*m*, and 46*k* is described.

The photosensitive drums 41 rotate in a rotation direction R and carry respective toner images and respective electrostatic latent images. The chargers 42, the developing devices 44, the static eliminators 45, and the cleaners 46 are disposed opposite to the circumferential surface of the respective photosensitive drums 41. Specifically, the chargers 42, the developing devices 44, the static eliminators 45, and the cleaners 46 are disposed in the stated order in the rotation direction R of the respective photosensitive drums 41.

The chargers 42 charge the respective photosensitive drums 41 to specific potential. In the present embodiment, the chargers 42 charge the corresponding photosensitive drums 41 to a specific positive potential by a method using a roller.

The developing devices 44 discharge toner to the respective photosensitive drums 41. Through the above, the electrostatic latent images formed on the respective photosensitive drums 41 are developed. As a result, toner images in the respective colors are formed on the respective photosensitive drums 41*y*, 41*c*, 41*m*, and 41*k*.

The static eliminator 45*y* is disposed between the photosensitive drums 41*y* and 41*c* that are adjacent to each other. The static eliminator 45*c* is disposed between the photosensitive drums 41*c* and 41*m* that are adjacent to each other. The static eliminator 45*m* is disposed between the photosensitive drums 41*m* and 41*k* that are adjacent to each other. The static eliminator 45*k* is disposed downstream of the photosensitive drum 41*k* in the circulation direction D of the intermediate transfer belt 51.

The static eliminators 45*y*, 45*c*, 45*m*, and 45*k* perform static elimination on the surfaces of the respective photosensitive drums 41*y*, 41*c*, 41*m*, and 41*k* after the respective toner images are transferred to the intermediate transfer belt 51, which may be hereinafter referred to as post-transfer elimination. Through the above, surface potential of the photosensitive drums 41 becomes substantially 0 V. Furthermore, the static eliminators 45*y*, 45*c*, and 45*m* except the static eliminator 45*k* respectively perform static elimination on the photosensitive drums 41*c*, 41*m*, and 41*k* before transfer of the corresponding toner images to the intermediate transfer belt 51, which may be hereinafter referred to as pre-transfer elimination. That is, the static eliminators 45*y*, 45*c*, and 45*m* respectively perform static elimination further on the respective photosensitive drums 41*c*, 41*k*, and 41*k* that are located downstream of the respective static eliminators 45*y*, 45*c*, and 45*m* in the circulation direction D of the intermediate transfer belt 51 (an example of a transfer target). Through the above, potential of parts of the respective photosensitive drums 41*c*, 41*m*, and 41*k* that each carry no toner image is reduced.

By contrast, the photosensitive drum 41*y* located the most upstream in the circulation direction D of the intermediate transfer belt 51 among the photosensitive drums 41*y*, 41*c*, 41*m*, and 41*k* is not subjected to pre-transfer elimination. In the above configuration, the surface potential of the photosensitive drum 41*y* may be higher than that of the other photosensitive drums 41*c*, 41*m*, and 41*k* in transfer of the respective toner images to the intermediate transfer belt 51.

The cleaners 46 each include a cleaning blade. The cleaning blades are in contact with the surfaces of the respective photosensitive drums 41 to scrape toner remaining on the surfaces of the respective photosensitive drums 41. Through the above, toner remaining on the surfaces of the respective photosensitive drums 41 is removed.

The transfer section 50 includes a drive roller 52, a driven roller 53, four primary transfer rollers 54*y*, 54*c*, 54*m*, and 54*k* that are examples of a plurality of transfer rollers, a power source 55*a* for transfer that is an example of a first power source for transfer, a secondary transfer roller 56, and four load resistors 57*y*, 57*c*, 57*m*, and 57*k*, in addition to the intermediate transfer belt 51. Note that the primary transfer rollers 54*y*, 54*c*, 54*m*, and 54*k* have substantially the same configuration. For the reason as above, the primary transfer rollers 54*y*, 54*c*, 54*m*, and 54*k* may be referred to as primary transfer rollers 54 in the following description in a situation in which matter common to the primary transfer rollers 54*y*, 54*c*, 54*m*, and 54*k* is described. Still, the load resistors 57*y*, 57*c*, 57*m*, and 57*k* have substantially the same configuration. For the reason as above, the load resistors 57*y*, 57*c*, 57*m*, and 57*k* may be referred to as load resistors 57 in the following description in a situation in which matter common to the road resistors 57*y*, 57*c*, 57*m*, and 57*k* is described.

The toner images in the respective colors formed on the respective photosensitive drum 41*y*, 41*c*, 41*m*, and 41*k* are transferred to the intermediate transfer belt 51 in a superimposed manner. The intermediate transfer belt 51 has a thickness of for example 80 μm to 120 μm. In the present embodiment, the intermediate transfer belt 51 includes a base layer of a base material such as polyamide (PA) in which carbon is dispersed as an example of conductive particles. The intermediate transfer belt 51 further includes an insulating resin layer that covers a surface of the base layer. The insulating resin layer is made from for example polycarbonate (PC) resin, acrylic resin, or fluorine-based resin. The insulating resin layer has a thickness of about several micrometers.

The drive roller 52 is rotated by drive power transmitted from a power supply. The intermediate transfer belt 51 is wound between the drive roller 52 and the driven roller 53. The driven roller 53 follows the rotation of the drive roller 52 to be rotated. The drive roller 52 and the driven roller 53 circulate the intermediate transfer belt 51 in the circulation direction D.

The primary transfer rollers 54 each are an elastic roller having an adjusted surface resistivity. The primary transfer rollers 54 each include a core bar and an elastic layer that covers an outer circumferential surface of the core bar. In the present embodiment, the elastic layer is made from a carbon-dispersed conductive rubber that is an elastic material in which carbon is dispersed as an example of conductive particles. Examples of such elastic materials include ethylene propylene rubber (EPDM) and nitrile rubber (NBR). The elastic layer has a thickness of about 3 mm. In the present embodiment, the primary transfer rollers 54*y*, 54*c*, 54*m*, and 54*k* each have a surface resistivity of at least $1.0\times10^6$ Ω/sq. at application of 1,000 V.

The primary transfer rollers 54*y*, 54*c*, 54*m*, and 54*k* are disposed opposite to the photosensitive drums 41*y*, 41*c*, 41*m*, and 41*k*, respectively, with the intermediate transfer belt 51 therebetween. The primary transfer rollers 54*c*, 54*c*, 54*m*, and 54*k* are disposed such that their rotational axes are displaced (offset) from rotational axes of the respective opposite photosensitive drums 41. Specifically, the primary transfer rollers 54 are offset downstream of the rotational axes of the respective opposite photosensitive drums 41 in the circulation direction D of the intermediate transfer belt 51. In the present embodiment, the rotational axes of the primary transfer rollers 54 are offset downstream of the rotational axes of the respective opposite photosensitive drums 41 by 4 mm in the circulation direction D of the intermediate transfer belt 51. Hereinafter, an amount in which the rotational axes of the primary transfer rollers 54 is offset from the rotational axes of the respective photosensitive drums 41 in the circulation direction D of the intermediate transfer belt 51 is referred to as an offset amount.

The power source 55*a* for transfer applies negative potential to all of the primary transfer rollers 54. In the present embodiment, the power source 55*a* for transfer is a constant voltage source that applies bias voltage to each of the primary transfer rollers 54*y*, 54*c*, 54*m*, and 54*k*. When the power source 55*a* for transfer applies the bias voltage to the respective primary transfer rollers 54*y*, 54*c*, 54*m*, and 54*k*, an electric field (transfer field) is generated between the primary transfer roller 54*y* and the photosensitive drum 41*y* corresponding to the primary transfer roller 54*y*. Similarly, electric fields (transfer electric fields) are generated between the primary transfer rollers 54*c*, 54*m*, and 54*k* and the respective photosensitive drums 41*c*, 41*m*, and 41*k* corresponding to the respective primary transfer rollers 54*c*, 54*m*, and 54*k*. The toner images formed on the surfaces of the respective photosensitive drums 41*y*, 41*c*, 41*m*, and 41*k* are transferred to the intermediate transfer belt 51 by the transfer electric fields. The value of the bias voltage is −1,600 V, for example.

The load resistor 57*y* is respectively connected in series between the primary transfer rollers 54*y* and the power source 55*a* for transfer. Similarly, the load resistors 57*c*, 57*m*, and 57*k* are respectively connected in series between the primary transfer rollers 54*c*, 54*m*, and 54*k* and the power source 55*a* for transfer. Still, the load resistors 57*y*, 57*c*, 57*m*, and 57*k* are connected in parallel to one another.

The load resistors 57*y*, 57*c*, 57*m*, and 57*k* each have a resistance value that is greater than a minimum system resistance value. A system resistance value can be obtained from a relationship (I-V characteristic) between the bias voltage generated by the power source 55*a* for transfer and a value of an electric current flowing to a corresponding one of the photosensitive drums 41*y*, 41*m*, 41*c*, and 41*k*.

A system resistance value is minimum in a situation in which a photosensitive layer of a photosensitive drum has a minimum film thickness and a surface of the photosensitive drum has a maximum potential. In the present embodiment, the photosensitive drum 41*y* that is not subjected to pre-transfer elimination has the highest surface potential among the photosensitive drums 41. As such, the system resistance value is minimum in a situation in which a photosensitive layer of the photosensitive drum 41*y* is the thinnest.

In a situation in which the single power source 55*a* for transfer applies the bias voltage to the primary transfer rollers 54*y*, 54*c*, 54*m*, and 54*k*, difference in value among the electric currents flowing to the respective photosensitive drums 41*y*, 41*c*, 41*m*, and 41*k* is reduced by setting the resistance values of the respective load resistors 57*y*, 57*c*, 57*m*, and 57*k* to be greater than the minimum system resistance value. For example, in a situation in which the minimum system resistance value is $1\times10^8\Omega$, the resistance values of the respective load resistors 57*y*, 57*c*, 57*m*, and 57*k* are preferably at least $1\times10^8\Omega$.

The load resistors 57*y*, 57*c*, 57*m*, and 57*k* may have resistance values different from one another. For example, the resistance values of the respective load resistors 57 may be set in decreasing order starting from the load resistor 57*y* located the most upstream in the circulation direction D of the intermediate transfer belt 51. Typically, the thickness of toner images transferred to the intermediate transfer belt 51 increases as the toner image moves downstream. Accordingly, electric currents having values greater those of electric currents flowing to the respective adjacently upstream primary transfer rollers 54*y*, 54*c*, and 54*m* preferably flow to the respective primary transfer rollers 54*c*, 54*m*, and 54*k*. Therefore, in a configuration in which the resistance values of the load resistors 57*y*, 57*c*, 57*m*, and 57*k* are set in decreasing order starting from the load resistor 57*y* located the most upstream in the circulation direction D of the intermediate transfer belt 51, the current values of the electric currents flowing to the respective primary transfer rollers 54*c*, 54*m*, and 54*k* are greater than those of the electric currents flowing to the respective adjacently upstream primary transfer rollers 54*y*, 54*c*, and 54*m*. In the above configuration, the toner images are transferred to the intermediate transfer belt 51 further reliably.

The secondary transfer roller 56 is pressed by the driven roller 53 to form a nip part N in cooperation with the driven roller 53. The secondary transfer roller 56 and the driven roller 53 transfer the toner images on the intermediate transfer belt 51 to the sheet S as the sheet S passes through the nip part N.

Figure 3:
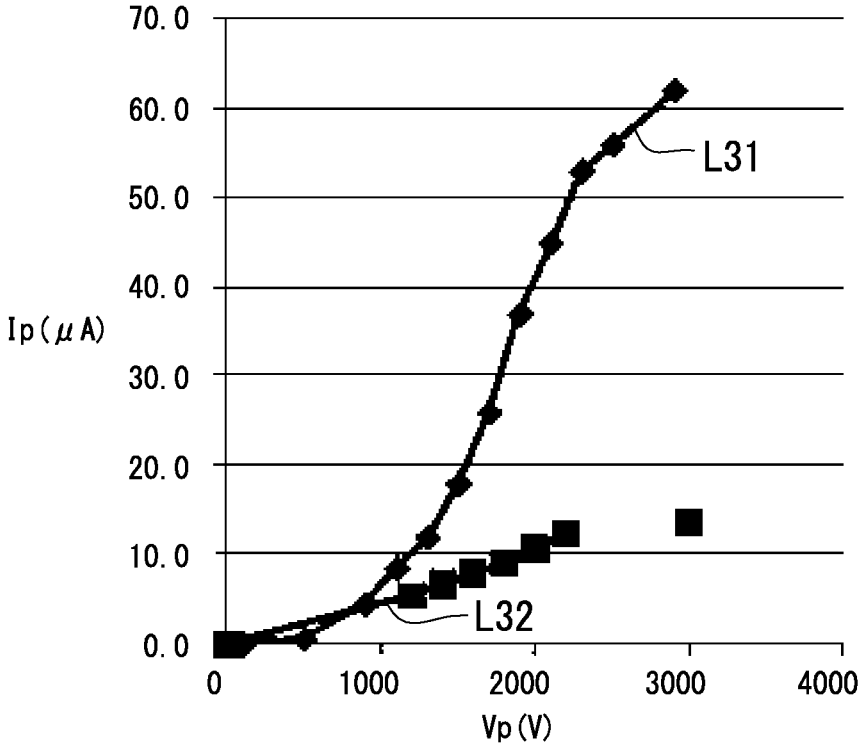
FIG. 3 is a graph representation in which values of electric currents flowing to photosensitive drums relative to bias voltage are plotted according to the first embodiment of the present invention.

With reference to FIGS. 1-3, a relationship between the electric currents flowing to the photosensitive drums 41 and the load resistors 57 will be described next using the photosensitive drum 41*y* as an example. Specifically, comparison is made between the electric current flowing to the photosensitive drums 41*y* in a configuration in which the load resistors 57 are connected to the respective primary transfer rollers 54 and the electric current flowing to the photosensitive drum 41*y* in a configuration in which the load resistors 57 are not connected to the respective primary transfer rollers 54. FIG. 3 is a graph representation (I-V characteristic) in which current values of the electric current flowing to the photosensitive drum 41*y* relative to the bias voltage are plotted.

Referring to FIG. 3, the horizontal axis represents voltage values Vp (V) of the bias voltage generated by the power source 55*a* for transfer and the vertical axis represents current values Ip (μA) of the electric current flowing to the photosensitive drum 41*y*. Note that current values Ip are values measured between a junction point P1 and the load resistor 57*y*. The junction point P1 is a junction point between the power source 55*a* for transfer and a corresponding one of the load resistors 57*y*, 57*c*, 57*m*, and 57*k*. Both the voltage values Vp (V) and the current values Ip (μA) are expressed in terms of absolute values.

A polygonal line L31 in FIG. 3 indicates current values Ip of the electric current flowing to the photosensitive drum 41*y* in a configuration in which the load resistors 57 are not connected between the respective primary transfer rollers 54 and the power source 55*a* for transfer. A polygonal line L32 indicates current values Ip of the electric current flowing to the photosensitive drum 41*y* in a configuration in which the load resistors 57*y*, 57*c*, 57*m*, and 57*k* are respectively connected in series between the power source 55*a* for transfer and a corresponding one of the primary transfer rollers 54*y*, 54*c*, 54*m*, and 54*k*.

In the configuration in which the load resistors 57 are connected in series between the power source 55*a* for transfer and the respective primary transfer rollers 54 (see the polygonal line L32), variation in current value Ip relative to variation in voltage values Vp is smaller than that in the configuration in which the load resistors 57 are not connected (see the polygonal line L31), as illustrated in FIG. 3. According to the present embodiment, connection of the load resistors 57*y*, 57*c*, 57*m*, and 57*k* can maintain the current values of the electric currents flowing to the photosensitive drums 41 low.

A description will be made next with reference to FIGS. 1, 2, and 4 about a relationship between the load resistors 57 and difference in current value of the electric currents flowing to the respective photosensitive drums 41*y*, 41*c*, 41*m*, and 41*k* using the photosensitive drums 41*y* and 41*c* as examples. Specifically, comparison is made between the configuration in which the load resistors 57 are not connected between the respective primary transfer rollers 54 and the power source 55*a* for transfer and the configuration in which the load resistors 57*y*, 57*c*, 57*m*, and 57*k* are connected in series between the respective primary transfer rollers 54 and the power source 55*a* for transfer.

Figure 4:
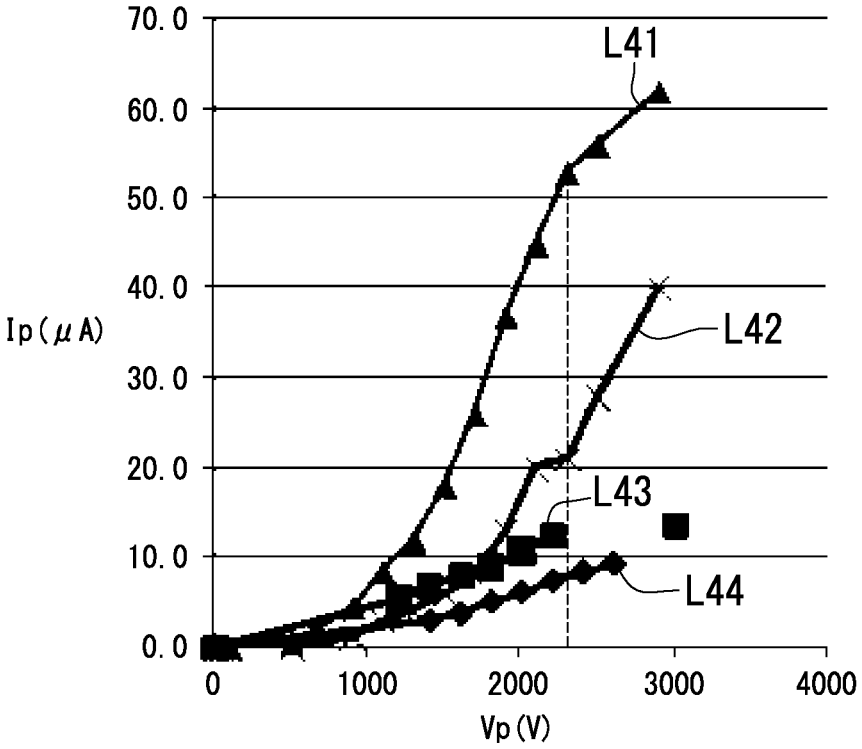
FIG. 4 is a graph representation in which values of electric currents flowing to photosensitive drums relative to bias voltage are plotted according to the first embodiment of the present invention.

FIG. 4 is a graph representation (I-V characteristic) in which values of electric currents flowing to the photosensitive drums 41*y* and 41*c* relative to voltage values Vp of bias voltage are plotted. In FIG. 4, the horizontal axis represents voltage values Vp (V) of the bias voltage generated by the power source 55*a* for transfer and the vertical axis represents current values Ip (μA) of electric currents flowing to the photosensitive drums 41*y* and 41*c*. Note that the current values Ip of the electric current flowing to the photosensitive drum 41*y* are measured between a corresponding junction point P1 and the load resistor 57*y*. The current values Ip of the electric current flowing to the photosensitive drum 41*c* are measured between a corresponding junction point P1 and the load resistor 57*c*. In addition, the voltage values Vp (V) of the bias voltage are expressed in terms of absolute values.

A polygonal line L41 in FIG. 4 indicates current values Ip of the electric current flowing to the photosensitive drum 41*y* in the configuration in which the load resistors 57 are not connected between the power source 55*a* for transfer and the respective primary transfer rollers 54. Specifically, the polygonal line L41 indicates the current values Ip of the electric current flowing to the photosensitive drum 41*y* in a configuration in which the photosensitive layer of the photosensitive drum 41*y* is the thinnest. A polygonal line L42 indicates current values Ip of the electric current flowing to the photosensitive drum 41*c* in the configuration in which the load resistors 57 are not connected between the power source 55*a* for transfer and the respective primary transfer rollers 54. Specifically, the polygonal line L42 indicates the current values Ip of the electric current flowing to the photosensitive drum 41*c* in a configuration in which the photosensitive layer of the photosensitive drum 41*c* is the thickest.

A polygonal line L43 indicates current values Ip of the electric current flowing to the photosensitive drum 41*y* in the configuration in which the load resistors 57*y*, 57*c*, 57*m*, and 57*k* are each connected between the power source 55*a* for transfer and a corresponding one of the primary transfer rollers 54*y*, 54*c*, 54*m*, and 54*k*. Specifically, the polygonal line L43 represents the current values Ip of the electric current flowing to the photosensitive drum 41*y* in the configuration in which the photosensitive layer of the photosensitive drum 41*y* is the thinnest. A polygonal line L44 represents current values Ip of the electric current flowing to the photosensitive drum 41*c* in the configuration in which the load resistors 57*y*, 57*c*, 57*m*, and 57*k* are each connected between the power source 55*a* for transfer and a corresponding one of the primary transfer rollers 54*y*, 54*c*, 54*m*, and 54*k*. Specifically, the polygonal line L44 represents the current values Ip of the electric current flowing to the photosensitive drum 41*c* in the configuration in which the photosensitive layer of the photosensitive drum 41*c* is the thickest.

In the configuration in which the load resistors 57 are not connected, a maximum difference in current value Ip between the electric current flowing to the photosensitive drum 41*y* (the polygonal line L41) and the electric current flowing to the photosensitive drum 41*c* (the polygonal line L42) is about 30 μA around a voltage value Vp of 2,200 V, as illustrated in FIG. 4.

By contrast, in the configuration in which the load resistors 57 are connected, a difference in current value Ip between the electric current flowing to the photosensitive drum 41*y* (the polygonal line L44) and the electric current flowing to the photosensitive drum 41*c* (the polygonal line L43) is no more than about 4.0 μA around a voltage value Vp of 2,200 V.

The photosensitive drum 41*y* among the photosensitive drums 41 that is not subjected to pre-transfer elimination has the highest surface potential of all in the present embodiment. By contrast, the photosensitive drums 41*c*, 41*m*, and 41*k* that is subjected to pre-transfer elimination have almost the same surface potential. In the above configuration, the current values of the electric currents flowing to the respective photosensitive drums 41*c*, 41*m*, and 41*k* are almost the same. As a result, the difference in current value Ip between the electric current flowing to the photosensitive drum 41*y* and the electric currents flowing to the respective photosensitive drums 41*m* and 41*k* is almost the same as the difference in current value Ip between the electric current flowing to the photosensitive drum 41*y* and the electric current flowing to the photosensitive drum 41*c*. Thus, the current values of the electric currents flowing to the respective photosensitive drums 41*y*, 41*c*, 41*m*, and 41*k* can be uniform and maintained low in the present embodiment.

As described above, the load resistors 57*y*, 57*c*, 57*m*, and 57*k* are respectively connected in series between the power source 55*a* for transfer and the primary transfer rollers 54*y*, 54*c*, 54*m*, and 54*k*. In the above configuration, even in a configuration in which the single power source 55*a* for transfer applies the bias voltage to each of the primary transfer rollers 54*y*, 54*c*, 54*m*, and 54*k*, the current values of the electric currents flowing to the respective photosensitive drums 41*y*, 41*c*, 41*m*, and 41*k* can be uniform and maintained low. As such, occurrence of transfer memory can be prevented even in a configuration in which the single power source 55*a* for transfer applies the bias voltage to the plurality of primary transfer rollers 54.

Note that although a situation in which polyamide (PA) is used as a base material contained in the intermediate transfer belt 51 is described in the present embodiment, the base material is not limited to polyamide. For example, any of polycarbonate (PC), polyimide (PI), and a polyamide alloy (PA alloy) is employable as the base material.

Furthermore, although the present embodiment describes a situation in which the base material contained in the intermediate transfer belt 51 is a thermoplastic resin such as polyamide, a thermosetting resin may be used rather than the thermoplastic resin.

Moreover, the offset amount in the present embodiment is, but not limited to, 4 mm. The offset amount may be 3 mm or 7 mm, for example.

Yet, the respective primary transfer rollers 54*y*, 54*c*, 54*m*, and 54*k* are offset downstream in the circulation direction D of the intermediate transfer belt 51 in the present embodiment. Alternatively, however, the primary transfer rollers 54*y*, 54*c*, 54*m*, and 54*k* may be offset upstream in the circulation direction D of the intermediate transfer belt 51.

Still further, the chargers 42 in the present embodiment charge the respective photosensitive drums 41 by a method using a roller. However, the method for charging the photosensitive drums 41 by the chargers 42 is not limited thereto. For example, the chargers 42 may charge the respective photosensitive drums 41 using a wire.

Figure 5:
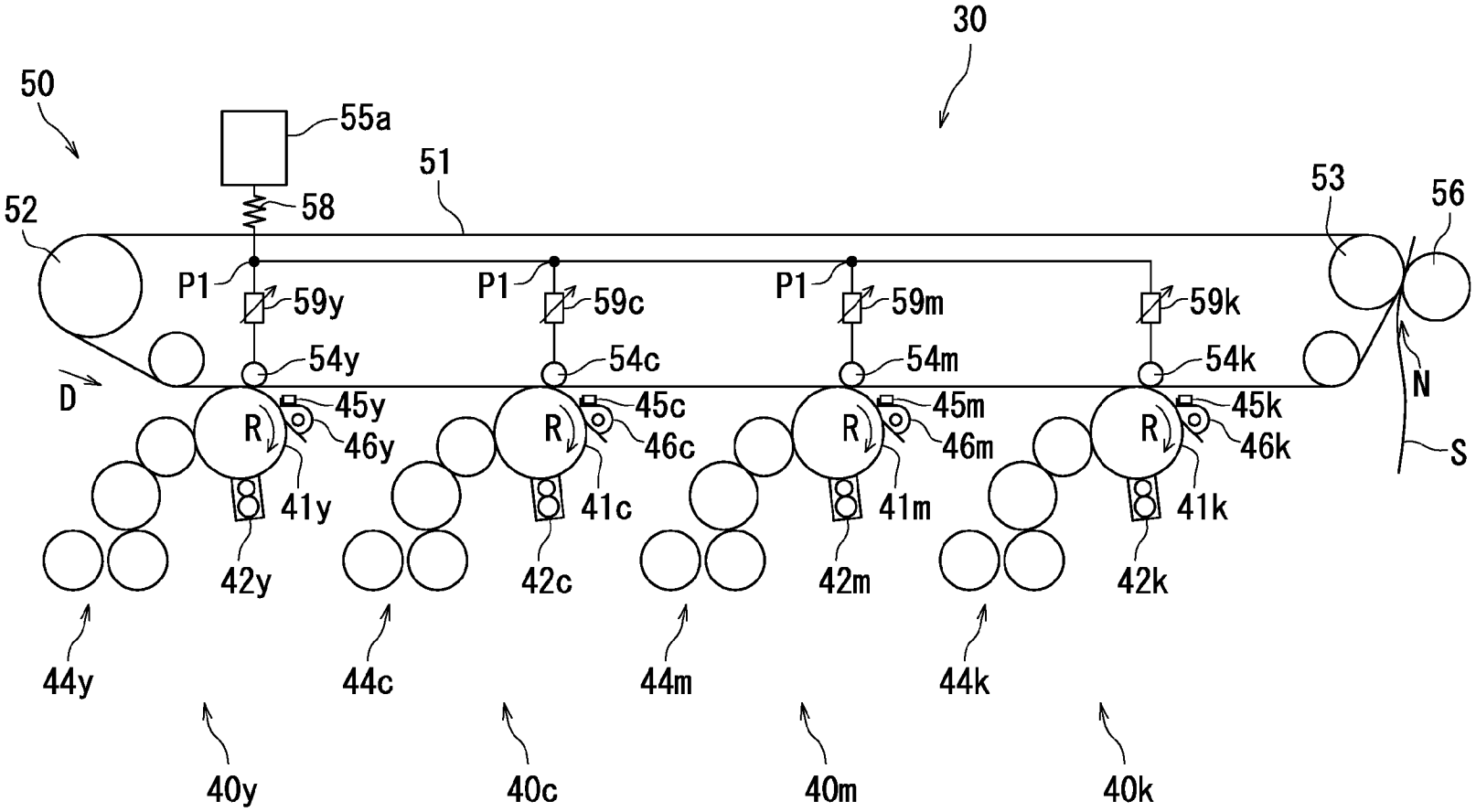
FIG. 5 is a schematic diagram illustrating another example of the image forming section according to the first embodiment of the present invention.

In addition, the present embodiment describes the configuration in which the load resistors 57*y*, 57*c*, 57*m*, and 57*k* are respectively connected in series between the power source 55*a* for transfer and the primary transfer rollers 54*y*, 54*c*, 54*m*, and 54*k*. Alternatively, however, variable resistors 59*y*, 59*m*, 59*c*, and 59*k*, rather than the load resistors 57*y*, 57*c*, 57*m*, and 57*k*, may be respectively connected between the power source 55*a* for transfer and the primary transfer rollers 54*y*, 54*c*, 54*m*, and 54*k*, as illustrated in FIG. 5. In the above configuration, the transfer section 50 further includes a resistor 58 disposed between the power source 55*a* for transfer and the junction points P1. The resistor 58 has a resistance value equivalent to the minimum system resistance value.

Second Embodiment

Figure 6:
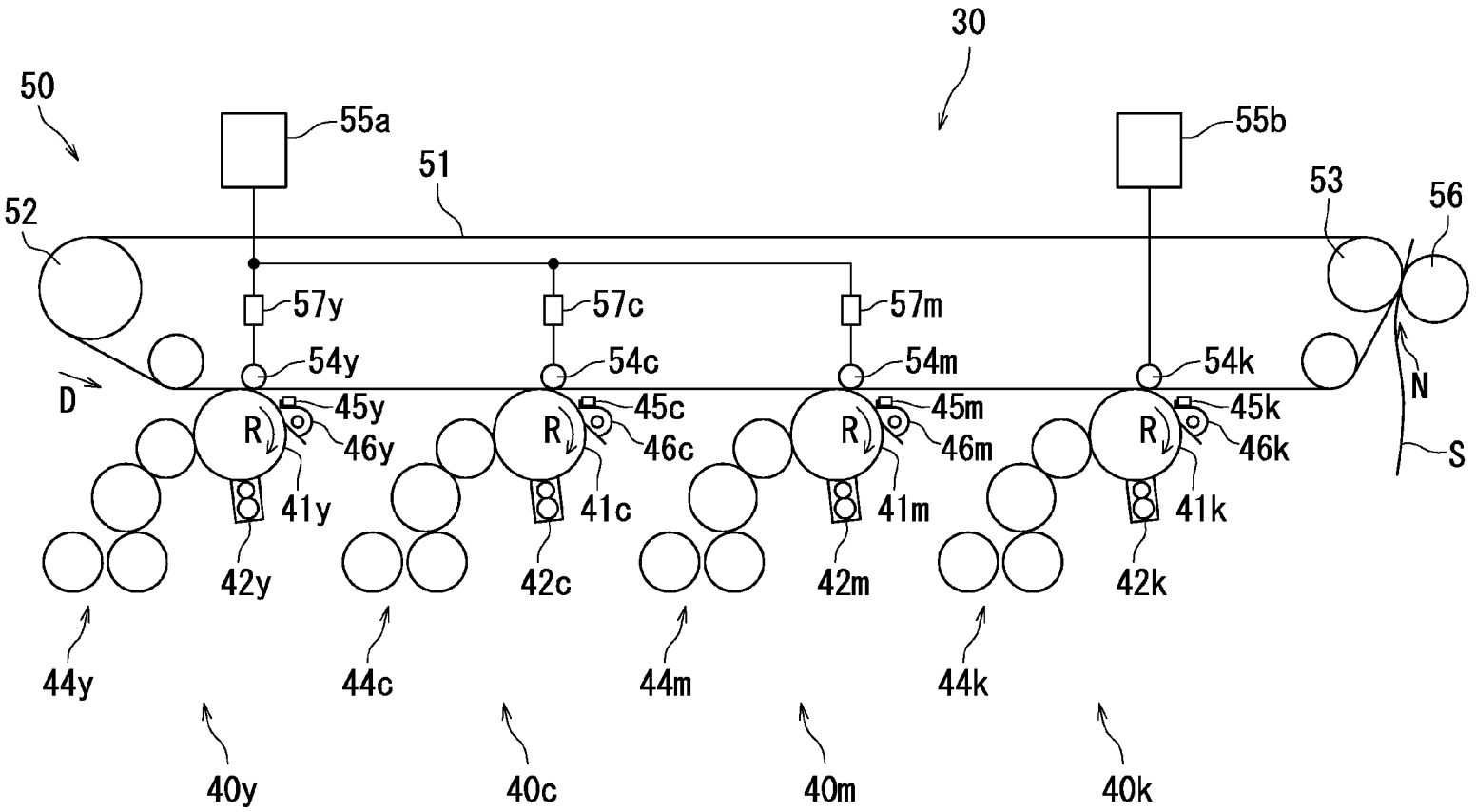
FIG. 6 is a schematic diagram illustrating a part of an image forming section according to a second embodiment of the present invention.

An image forming apparatus 1 according to a second embodiment of the present invention will be described next with reference to FIGS. 1 and 6. FIG. 6 is a schematic diagram illustrating a part of an image forming section 30 according to the second embodiment. In the second embodiment, the image forming section 30 (the transfer section 50) includes a power source 55*b* for transfer in addition to the power source 55*a* for transfer. Specifically, bias voltage is applied from the power source 55*b* for transfer to the primary transfer roller 54*k* in the second embodiment. The following describes the second embodiment based on differences compared with the first embodiment and omits description of matter that is the same as for the first embodiment.

As illustrated in FIG. 6, the power source 55*a* for transfer in the present embodiment applies bias voltage to the primary transfer rollers 54*y*, 54*c*, and 54*m* that are located upstream of the primary transfer roller 54*k*. In other words, the power source 55*a* for transfer applies the bias voltage to each of at least two primary transfer rollers (the primary transfer rollers 54*y*, 54*c*, and 54*m* in the present embodiment) including the primary transfer roller 54*y* located the most upstream in the circulation direction D of the intermediate transfer belt 51. The power source 55*b* for transfer is connected in series to the primary transfer roller 54*k* located the most downstream in the circulation direction D of the intermediate transfer belt 51 to apply the bias voltage to the primary transfer roller 54*k*.

As described above, the image forming apparatus 1 includes the power source 55*b* for transfer in addition to the power source 55*a* for transfer. In the above configuration of the image forming apparatus 1, bias voltage can be applied to only the primary transfer roller 54*k* without being applied to the other primary transfer rollers 54*y*, 54*c*, and 54*m* in a situation in which an image is formed using only a black toner. In the above configuration, power consumption in the image forming apparatus 1 can be maintained low. Note that the load resistor 57*k* may be connected in series between the power source 55*b* for transfer and the primary transfer roller 54*k*.

The embodiments of the present invention have been described so far with reference to the drawings (FIGS. 1-6). However, the present invention is not limited to the specific embodiments described above and can be practiced in various ways within the scope not departing from the essence of the present invention.

For example, the embodiments of the present invention describe a situation in which the present invention is applied to the image forming apparatus 1 using an intermediate transfer belt but may be applicable to an image forming apparatus using a direct transfer belt. In the above configuration, a recording medium such as a sheet S corresponds to the transfer target.

Furthermore, the power sources 55*a* and 55*b* for transfer each are a constant voltage source in the embodiments of the present invention but may each be a constant current source.

In addition, the present invention is applied to a multifunction peripheral in the embodiment of the present invention. However, the present invention is applicable to a copier, a printer, etc.

INDUSTRIAL APPLICABILITY

The present invention is applicable to a field of image forming apparatuses.

The invention claimed is:

1. An image forming apparatus that forms an image by transferring toner images to a transfer target in a superimposed manner, the image forming apparatus comprising:

a plurality of photosensitive drums disposed in a movement direction of the transfer target;

a plurality of static eliminators that are disposed downstream of the respective photosensitive drums in the movement direction of the transfer target and that are configured to perform pre-transfer erase that is static elimination on the respective photosensitive drums located upstream in the movement direction of the transfer target;

a plurality of transfer rollers disposed opposite to the respective photosensitive drums;

a first power source for transfer configured to apply potential to each of at least two transfer rollers including a transfer roller located the most upstream in the movement direction of the transfer target among the plurality of transfer rollers; and a plurality of load resistors that are connected in parallel to one another and in series between the first power source for transfer and the respective at least two transfer rollers to which the first power source for transfer applies potential, wherein a static eliminator among the plurality of static eliminators that is located between adjacent photosensitive drums in the movement direction of the transfer target performs post-transfer erase that is static elimination further on a photosensitive drum that is located downstream thereof in the movement direction of the transfer target among the adjacent photosensitive drums, the plurality of load resistors have respective resistance values that each are equal to or larger than a minimum system resistance value of system resistance values, the system resistance values include resistance values of the transfer rollers each connected to a corresponding one of the load resistors and resistance values of the plurality of photosensitive drums each located opposite to a corresponding one of the transfer rollers, and the minimum system resistance value include a resistance value of a photosensitive drum among the plurality of photosensitive drums on which the pre-transfer erase is not performed.

2. The image forming apparatus according to claim 1, wherein the system resistance values each further include a resistance value of the transfer target.

3. The image forming apparatus according to claim 1, wherein resistance values of load resistors connected between the first power source for transfer and the at least two transfer rollers to which the first power source for transfer applies potential are set in decreasing order starting from a load resistor located the most upstream in the movement direction of the transfer target.

4. The image forming apparatus according to claim 1, wherein the first power source for transfer applies potential to each of the transfer rollers.

5. The image forming apparatus according to claim 1, further comprising:

a second power source for transfer configured to apply potential to a transfer roller among the plurality of transfer rollers that is located the most downstream in the movement direction of the transfer target, wherein the first power source for transfer applies potential to each of transfer rollers located upstream of the transfer roller in the movement direction of the transfer target to which the second power source for transfer applies potential.

6. The image forming apparatus according to claim 5, further comprising:

a load resistor connected in series between the second power source and the transfer roller to which the second power source for transfer applies potential.

7. The image forming apparatus according to claim 1, wherein the transfer rollers include an elastic roller.

8. The image forming apparatus according to claim 7, wherein the elastic roller contains conductive particles.

9. The image forming apparatus according to claim 8, wherein the conductive particles each contain carbon.

10. The image forming apparatus according to claim 1, wherein the transfer rollers have respective rotational axes that are displaced either upstream or downstream of rotational axes of the respective opposite photosensitive drums in the movement direction of the transfer target.

* * * * *